US005212932A

United States Patent [19]

Raudat

[11] Patent Number: 5,212,932

[45] Date of Patent: May 25, 1993

[54] APPARATUS FOR LOADING FRANGIBLE ARTICLES INVERTED INTO PACKING CASE

[75] Inventor: John L. Raudat, North Madison, Conn.

[73] Assignee: Standard-Knspp, Inc., Portland, Conn.

[21] Appl. No.: 903,624

[22] Filed: Jun. 24, 1992

[51] Int. Cl.[5] ..... B65B 21/04; B65B 35/58

[52] U.S. Cl. ..... 53/539; 53/247; 53/248; 53/262; 53/544

[58] Field of Search ..... 53/539, 544, 543, 248, 53/247, 251, 250, 249, 143, 262, 261, 260, 446, 448

[56] References Cited

U.S. PATENT DOCUMENTS

| | | | |
|---|---|---|---|
| 2,890,553 | 6/1959 | Day et al. | 53/539 X |
| 3,694,993 | 10/1972 | East | 53/544 X |
| 3,702,524 | 11/1972 | Johnson et al. | 53/544 X |
| 3,834,117 | 9/1974 | Gift | 53/544 X |
| 4,048,783 | 9/1977 | Raudat et al. | 53/544 X |
| 4,408,436 | 10/1983 | Glover | 53/248 X |
| 4,457,121 | 7/1984 | Johnson et al. | 53/248 X |

*Primary Examiner*—James F. Coan

*Attorney, Agent, or Firm*—McCormick, Paulding & Huber

[57] ABSTRACT

Groups of articles are received from a conventional drop packer grid, into one side of a rotatable carrier that defines pockets for receiving the articles. Each pocket is defined by upright fingers that form funnels for each article. These fingers are resiliently deformed by a star shaped cam located alongside each pocket so as to close around each article and hold it securely while the carrier is inverted. A second set of pockets accepts a second charge of articles while the first charge is dropped into a case lifted into place below the carrier. This case can be so positioned while the fingers are closed to reduce the verticle height through which the articles are dropped.

12 Claims, 8 Drawing Sheets

APPARATUS FOR LOADING FRANGIBLE ARTICLES INVERTED INTO PACKING CASE

This invention relates generally to the loading of frangible articles such as glassware or plastic bottles into packing cases, and deals more particularly with a drop packer which is adapted to invert the articles and to handle each article individually with a minimum drop distance between the article and the awaiting case.

BACKGROUND OF THE INVENTION

Conventional means is provided for forming a slug of articles to be dropped, and the articles are preferably dropped right side up into a unique funnel mechanism which not only controls the downward movement of the articles to minimize the drop distance for the articles but which also inverts the articles for drop packing into the awaiting case.

The articles are inverted by rotating a module designed to hold at least one and preferably two charges of articles, one on each side of the invert module itself. This disclosure represents an improvement over prior art U.S. Pat. No. 3,702,524 issued to Johnson et al in November 1972. That patent provided for hinged doors to restrain the articles during the invert motion, and these doors have been eliminated in the present disclosure in favor of unique fingers which not only serve to entrap the article during the invert motion but which also serve to guide each article during its downward movement into the awaiting packing case.

Other prior art patents which invert the articles being packaged are shown in U.S. Pat. No. 3,834,117 issued to Gift in September of 1974, wherein the hinged doors are replaced by an inflatable lane defining grid structure, and in U.S. Pat. No. 3,694,933 wherein vacuum cups support the articles during invert motion.

Another approach to drop packing articles without inverting them, but with a descending grid to control the paths the articles take as they move downwardly into an awaiting packing case is shown in Day et al U.S. Pat. No. 2,890,553 wherein a descending funnel type grid is provided for initially supporting the upright articles between fingers so that they can be lowered and subsequently dropped into the packing case as the fingers are allowed to assume normal open positions. The disclosure in Day differs from that of the present invention in that the articles in Day are not inverted, nor need the articles be retained during invert motion. More specifically, the cammed fingers of the funnel in Day would not retain the articles in an apparatus for inverting the articles during the packing operation.

U.S. Pat. No. 4,457,121 issued to Johnson et al shows still another approach to drop packing or lowering articles downwardly into a packing case. More specifically, in Johnson the articles are held between the spring fingers of the funnel portion of the grid. However, there is no suggestion in this Johnson patent of retaining the articles in a finger type funnel or grid so that the articles can be inverted, and hence no suggestion of using the fingers to hold the articles in place during such invert motion.

SUMMARY OF THE INVENTION

In its presently preferred form the apparatus of the present invention includes means for feeding articles in a plurality of side-by-side lanes in a predetermined direction, and a lane defining grid is provided for receiving successive charges of articles therein. Article supporting elements are movably provided in the grid for selectively releasing the charge of articles for descent out of this lane defining grid.

Article carrier means is provided below the grid and defines pockets for receiving the individual articles so released. The carrier means includes a first set of finger assemblies defining a first set of pockets, and these assemblies are arranged between these articles receiving pockets. The individual fingers have movable free end portions forming funnels for receiving the articles into these pockets when the fingers are in their open positions. Means is provided for moving these finger end portions from open to closed positions, and invert means is provided for rotating the carrier means on a horizontal axis from the above described article receiving position to a load station where the articles are dropped inverted into an open packing case as a result of opening the fingers.

Each finger assembly includes a finger holder for the fingers of each such assembly, and a rock shaft oriented perpendicular to the axis of rotation of the carrier means which rock shaft is rotatably received in each holder and which includes a cam rotatably mounted on the rock shaft for engaging the fingers to achieve the finger movement required to retain the articles in their respect pockets during the invert motion.

The rock shafts are collectively moved by means of a cam plate slidably received in the carrier means. The carrier means preferably includes at least two sets of finger assemblies defining oppositely arranged pockets for receiving articles in alternate positions of the carrier means as the carrier means moves 180 degrees between an upright and an invert position. Each of these sets of finger assemblies, when inverted, is adapted to guide an associated group or slug of articles into the awaiting packing case. The fingers are opened only after a case has been lifted into position for receiving the articles so that the articles are securely held in position until released for relatively short movement downwardly into the packing case.

DETAILED DESCRIPTION

Figure 1:
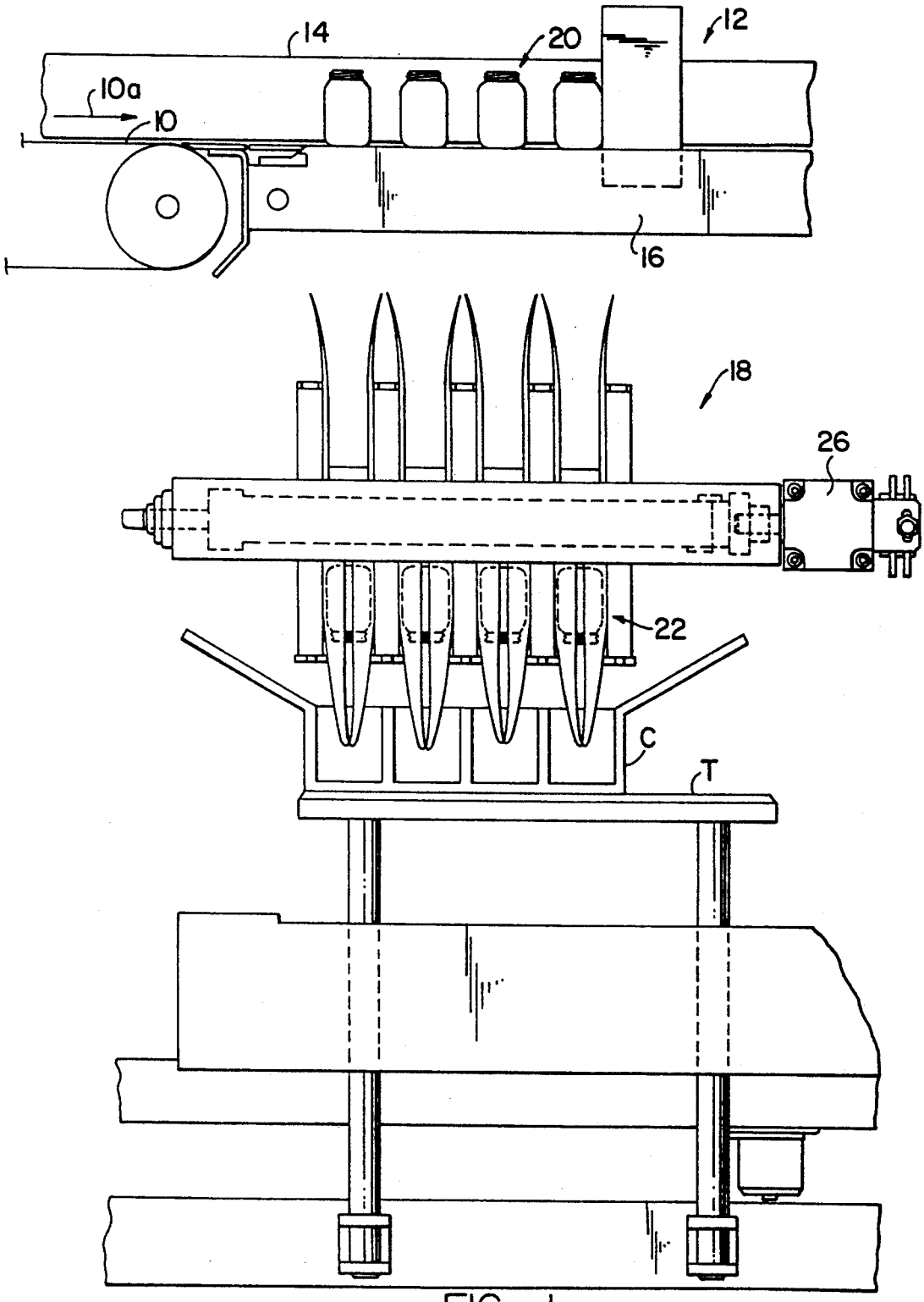
FIG. 1 is a side elevational view showing in schematic fashion and with portions deleted the general arrangement for the various components of the present invention.

Turning now to the drawings in greater detail, FIG. 1 illustrates an article infeed conveyor 10 capable of feeding articles such as glassware in a downstream direction as indicated generally by the arrow 10*a*. The conveyor 10 has provided at its downstream end a conventional shifting grid assembly indicated generally at 12. The grid assembly 12 is designed to receive successive groups or slugs of articles so that these groups can be drop packed into an upwardly open packing case. The reader is referred to prior art U.S. Pat. No. 4,432,189 for a more complete description of such a shifting grid style packer for a more complete description of this portion of the present disclosure. Said U.S. Pat. No. 4,432,189 is incorporated by reference herein.

As disclosed in said patent the shifting grid provides fixed lane guides for receiving columns of articles in an array or slug which can be isolated from articles on the infeed conveyor by upright posts provided on a shifting plate. The articles to be dropped are supported on the shifting grid rails, such as illustrated at 16 in FIGS. 2A–2D inclusively. These rails move with the shifting plate (not shown) to a predetermined position at which the plate and its posts stop. As disclosed in said U.S. Pat. No. 4,432,189 the rails continue to move both laterally and so as to separate the articles being dropped from those held back by the posts. The shifting grid rails 16 and associated lane defining means 14 illustrated in FIG. 2A–2D are described in detail in said patent.

Figure 2B:
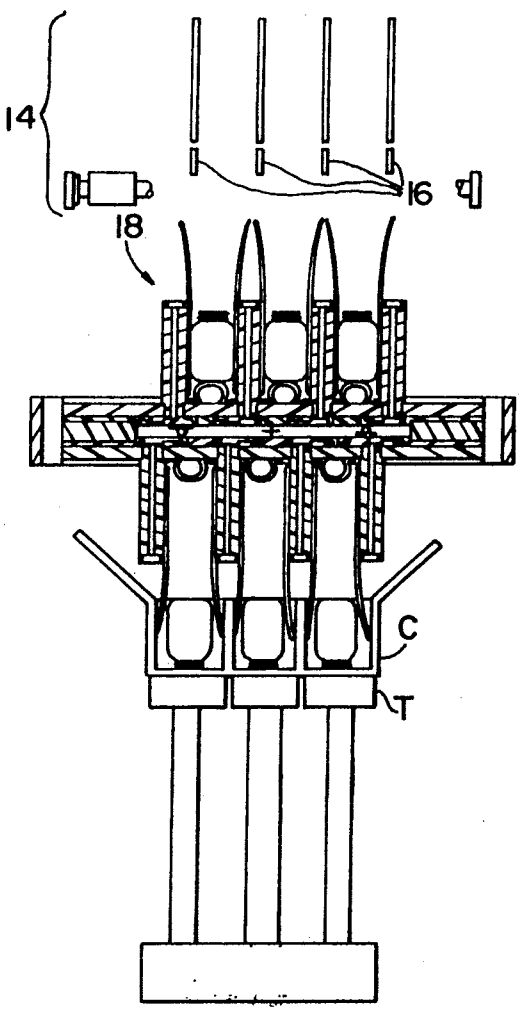
FIG. 2B is a view similar to FIG. 2A but taken at a slightly later instant of time.
Figure 2A:
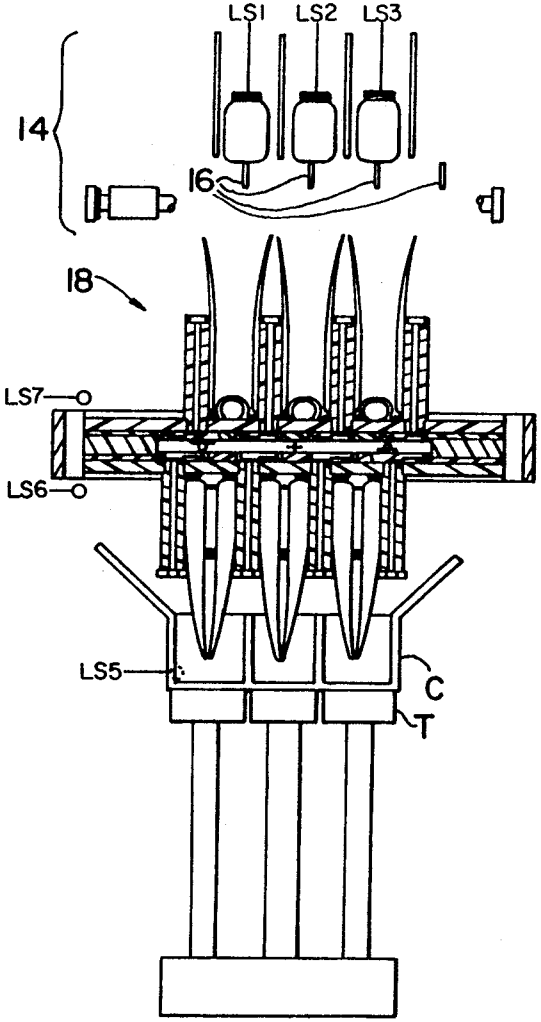
FIG. 2A is an end view of the apparatus illustrated in FIG. 1 showing the configuration at the start of a first cycle of operation.
Figure 7:
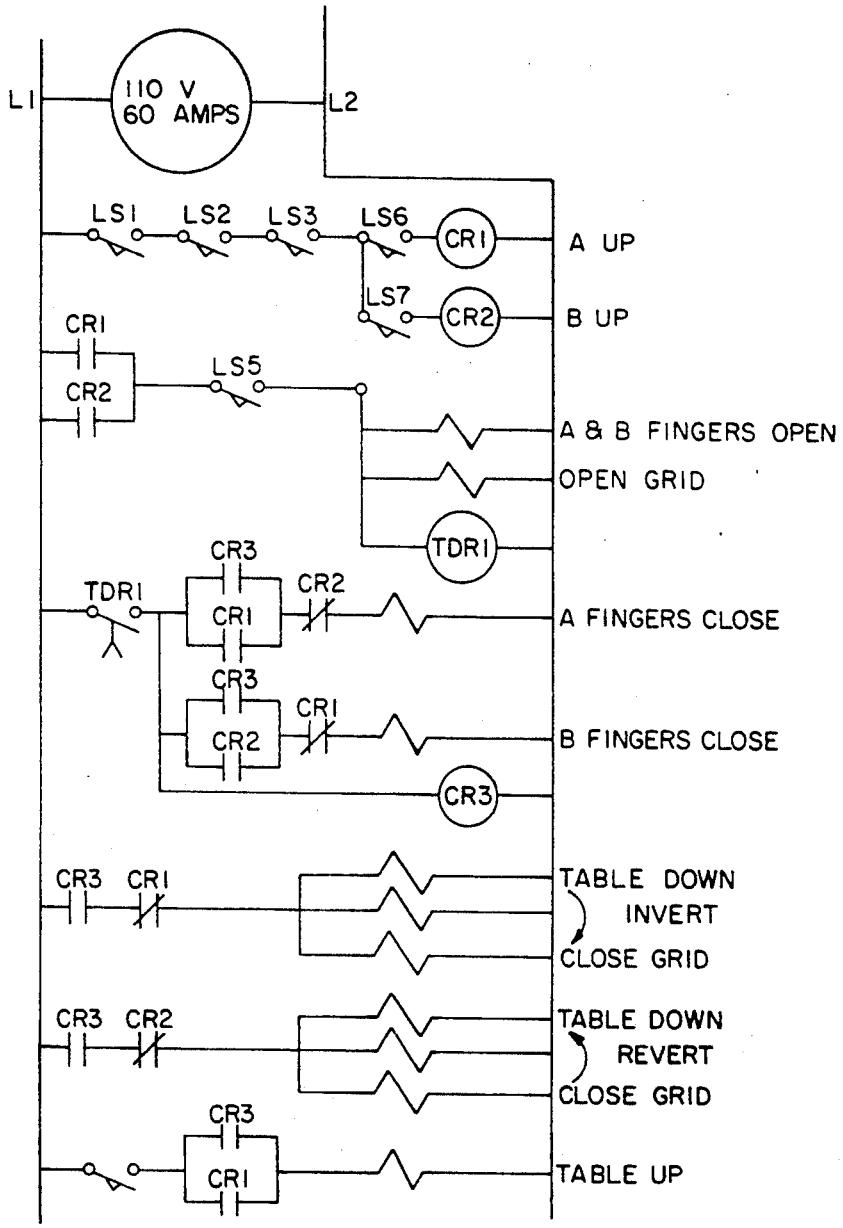
FIG. 7 is a control circuit for operating the movable components depicted in FIGS. 1–6.

Lane detector devices are also provided, but not shown herein except for their associated switches as indicated generally at LS1, LS2 and LS3 in FIG. 2A and in FIG. 7. These lane detector switches provide electrical signal when the grid is full. The rails 16 of the shifting grid are movable from the FIG. 2A position supporting the articles to the position shown in FIG. 2B wherein the articles are free to drop into the pockets defined for them by the carrier means 18.

The charge or slug of articles so received in these pockets is indicated schematically at 20 in FIG. 1, and as shown in FIG. 1 a similar charge or slug of articles is adapted to be retained in an opposite side of the carrier means structure 18 as suggested generally at 22 in FIG. 1. A reversible motor 26 is coupled to the carrier means structure 18 for rotating the carrier means between diametrically opposed limit positions that allow one slug of articles to be deposited on the carrier while another slug of articles is being released from the carrier and loaded into the case.

Figure 2D:
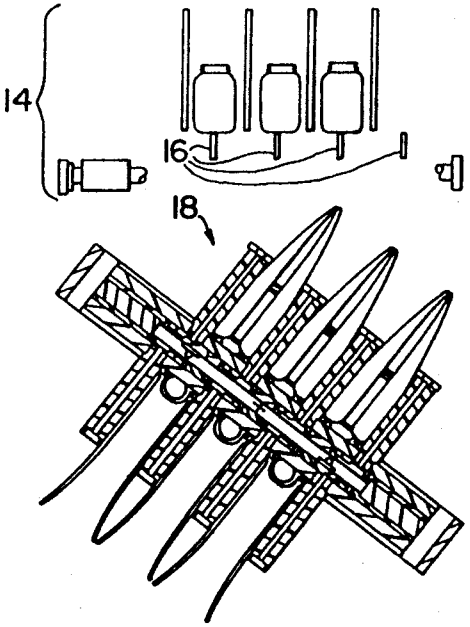
FIG. 2D is a view similar to FIGS. 2A, 2B and 2C taken at a still later instant of time.
Figure 2D:
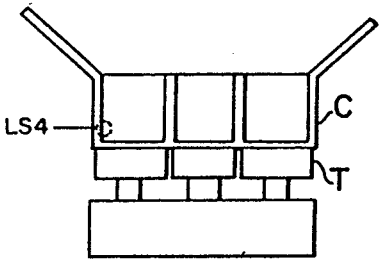
Figure 2C:
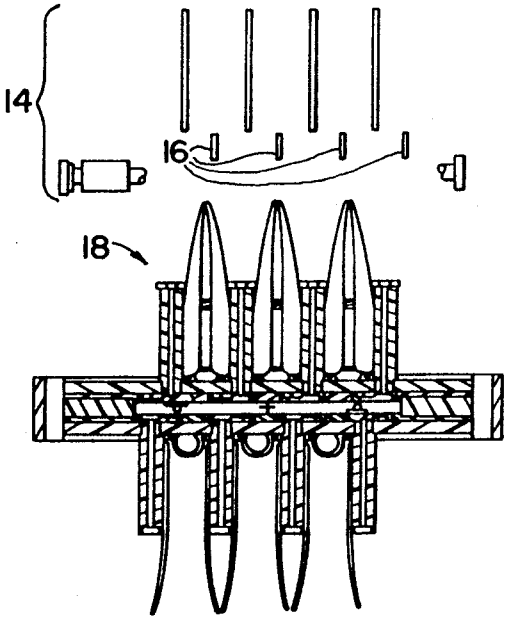
FIG. 2C is a view similar to FIGS. 2A and 2B but taken at a still later instant of time during at typical cycle.
Figure 2C:
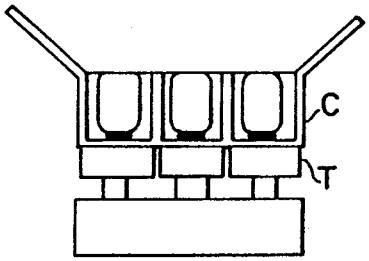

As shown somewhat schematically in FIGS. 2A–2D inclusively each slug of glassware articles is dropped from the shifting grid structure into the upper side of the carrier means as suggested at the upper side of the carrier or invert module 18. Upwardly projecting flexible resilient fingers of the carrier form pockets for receiving the articles, and cushions at the bottom of each pocket serve to soften the impact between each article and the invert module 18. FIG. 2C shows the resilient plastic fingers cammed closed by means to be described so the slug of articles can be rotated and inverted (FIG. 2D). Upon completion of the invert motion (FIG. 2B) the fingers again open (compare FIGS. 2A and 2B) and the articles drop downwardly into a case or carton C. The case is lifted into position for loading by a lift table T prior to reopening of the closed fingers (FIG. 2A) so that the fingers will open inside the partitioned packing case C (FIG. 2B). The loaded case is then lowered on the table T so that the invert module or carriage can be returned into position for receiving another slug in that side of the carrier that has just been emptied.

Figure 3:
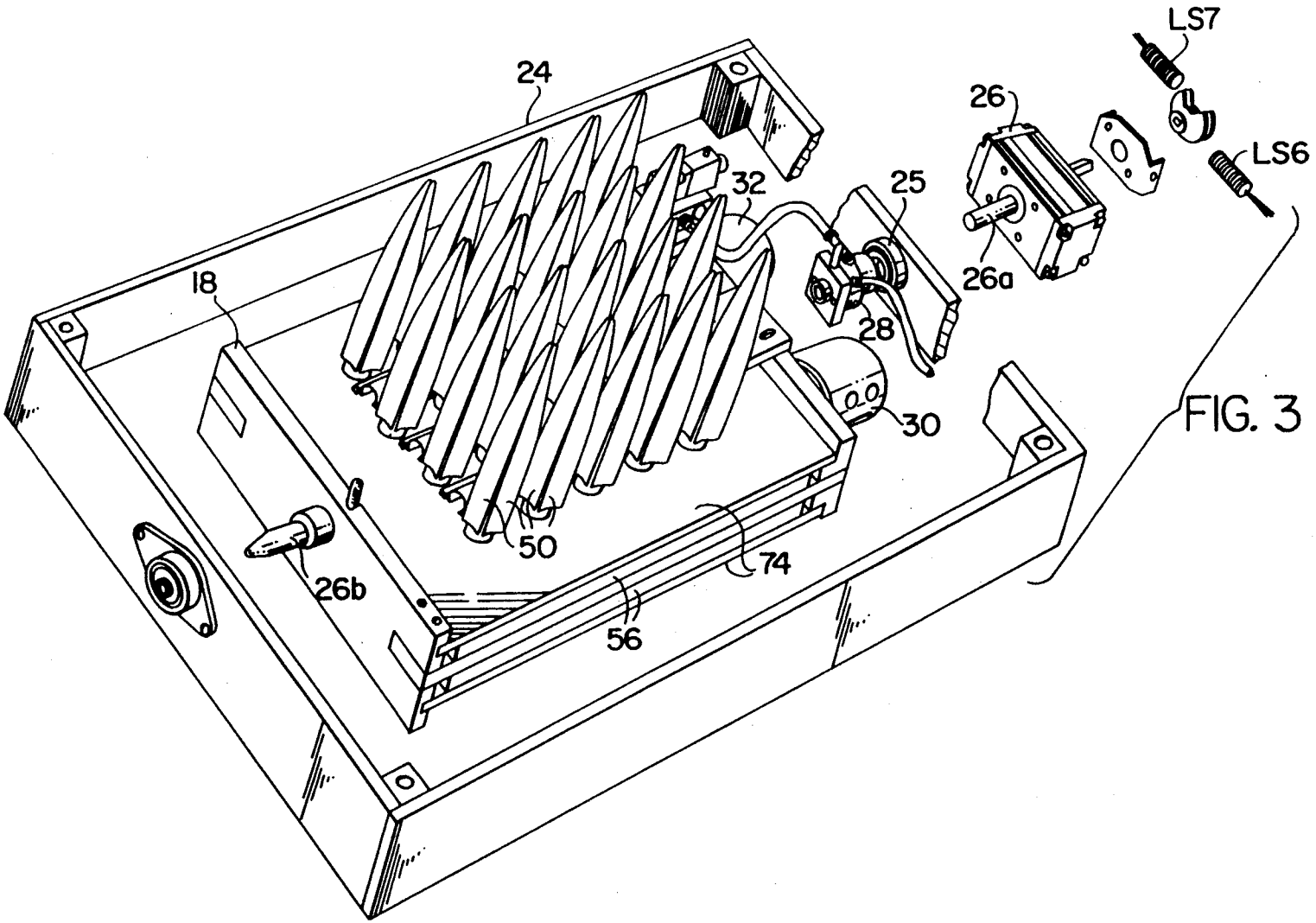
FIG. 3 is a perspective view illustrating the invert module and associated components some of which are shown in exploded relationship.

Referring now more specifically to FIG. 3, the carrier or invert module 18 is rotatably supported in a fixed support frame 24. This support frame 24 is vertically adjustable in the machine frame (not shown) so as to permit the invert module or carrier to be set up for handling articles of various height. Corner posts 24*a*, 24*a* threadably receive vertically oriented jack shafts (not shown) to permit this vertical adjustment. As mentioned previously the invert module 18 includes two oppositely arranged sets of finger assemblies (only one of which is shown in FIG. 3) that cooperate to define the various pockets required to receive and/or support two arrays or slugs of articles as suggested in FIG. 1. The fingers are arranged between adjacent pockets in clusters or finger assemblies. It will be apparent that the opposite side of the carrier 18 is configured in the same fashion as described previously for handling two arrays or slugs of articles as mentioned previously.

Figures 4, 4A:
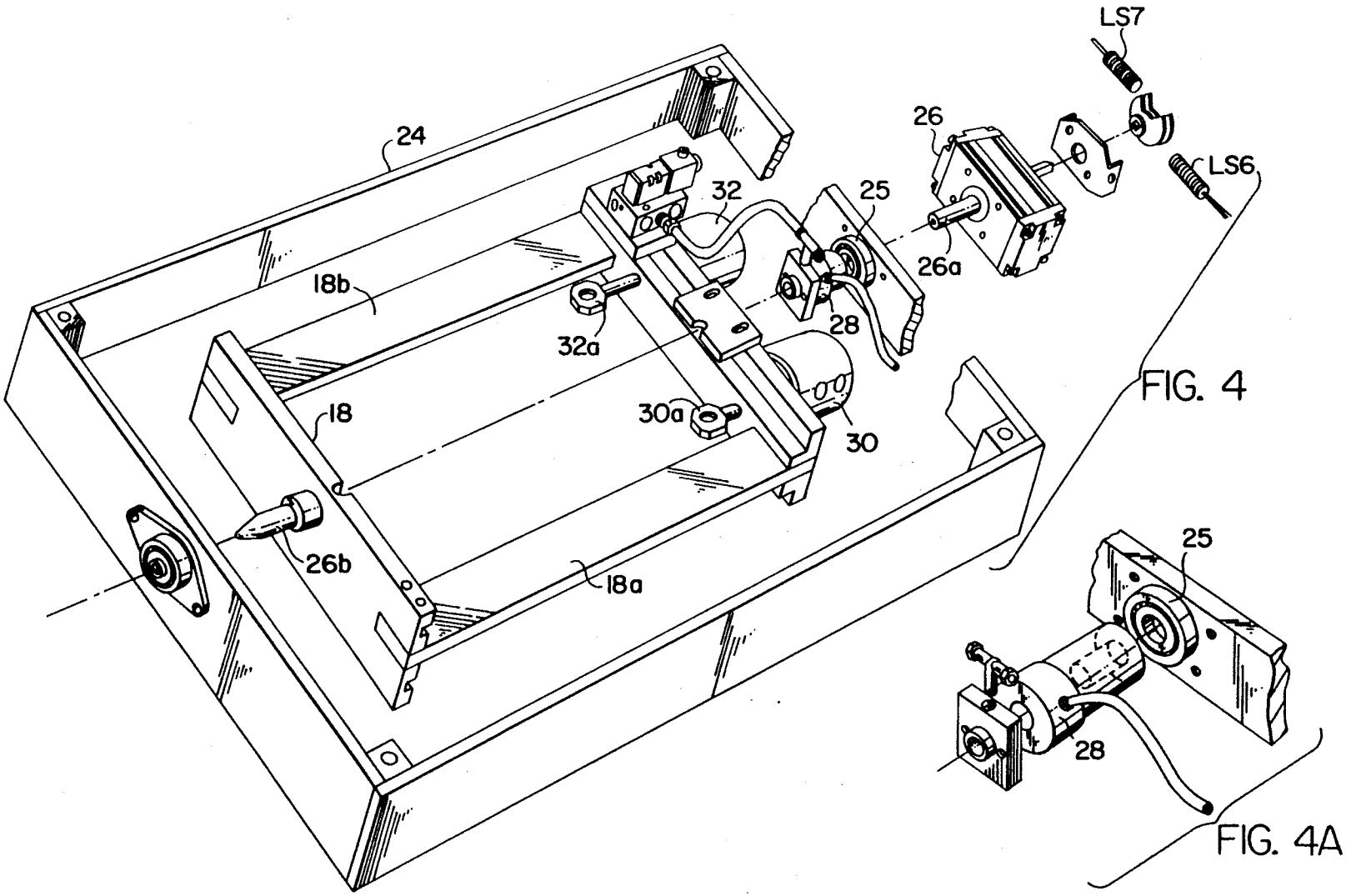
FIG. 4 is a view similar to FIG. 3 showing additional components but with the finger assemblies and associated cam plates omitted.
FIG. 4A illustrates a portion of the apparatus of FIG. 4 in somewhat greater detail.

FIG. 4 illustrates the structure of FIG. 3 in somewhat greater detail, however both pocket defining sets of finger assemblies have been omitted so as to afford more detail on other parts of the carrier or invert module. The means for rotating the carrier comprises a pneumatic actuator 26 of the rack and pinion type which rotates an output shaft 26*a* . The output shaft 26*a* is in turn connected to the invert module or carrier 18 through a bearing 25 provided at the head side of the assembly as shown. A fluid coupling 28 best shown in FIG. 4A provides air selectively to one or the other or both of two cam plate shifting actuator cylinders 30 and 32. These actuators have movable portions, 30*a* and 32*a* respectively for operation of the cam plates (not shown in this view). These cam plates are slidably supported on rails 18*a* and 18*b* respectively will be described in greater detail with reference to FIGS. 5 and 6.

Proximity switches or limit switches LS6 and LS7 are so located as to be tripped by cams provided on the opposite end of the rack and pinion actuator shaft 26*a* in order to provide input signals to a control system such as shown in FIG. 7. When one or the other of these switches is closed this FIG. 7 circuit controls the positions taken by the fingers as a function of the invert module carrier being in position to either receive or to drop a charge of articles.

Figure 5:
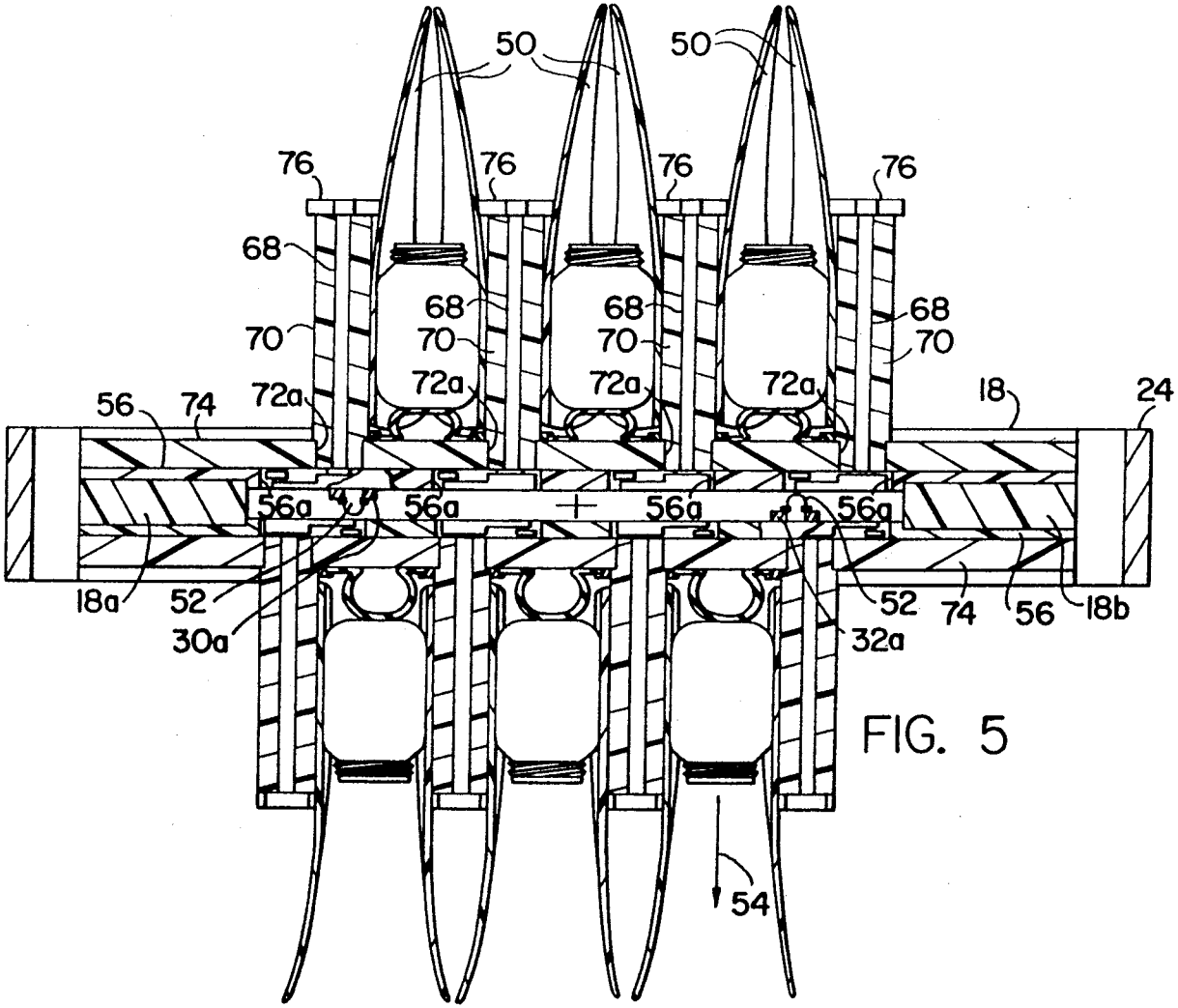
FIG. 5 is a lateral sectional view taken through the invert module during a typical cycle of operation.

As suggested at the top of FIG. 5 once a charge or slug of articles has been received in the pockets defined by the upstanding fingers 50, 50 (four such fingers defining an individual pocket) these fingers are adapted to be moved from their open positions to their closed positions with the result that the articles will be captured within the pockets as shown at the upper side of FIG. 5. As suggested at the bottom of FIG. 5 once the carrier means or invert module has completed its rotational 180 degree travel the fingers open 5 to release the articles for downward movement into the case as indicated by the arrow 54.

Figures 6, 6A:
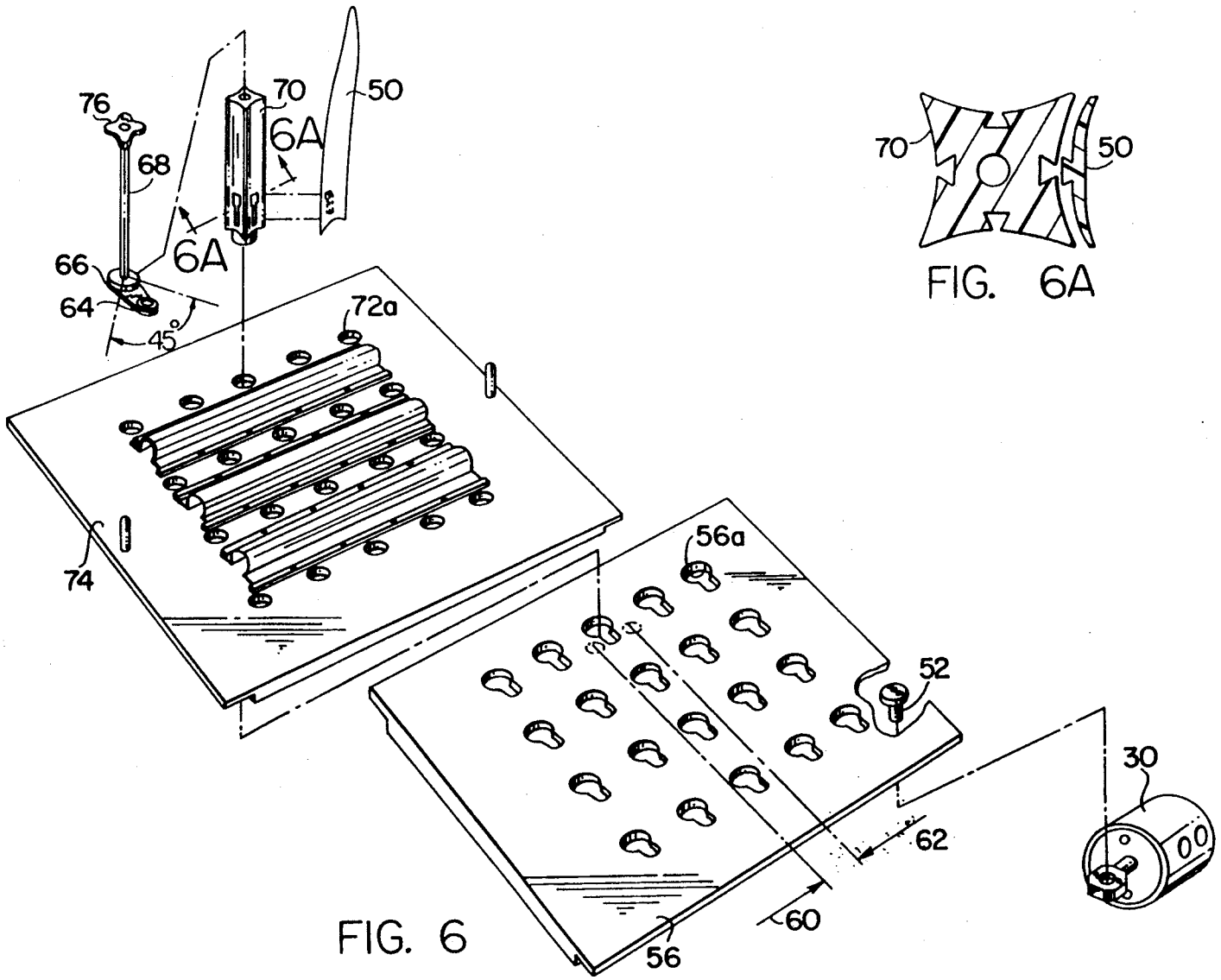
FIG. 6 is a perspective view of the components comprising one side of the carriage means or invert module with the components thereof illustrated in exploded relationship.
FIG. 6A illustrates the cross sectional configuration for the holder illustrated in FIG. 6 and is taken generally on the line 6A—6A of that view.

Turning now to a description of FIG. 6, each shifting cam plate 56 has a pin 52 that is moved by an actuator 30 (or 32). The reversible linear movement of the cam plate 56 is in the direction of the arrows indicated generally at 60 and 62 in FIG. 6. The cam plate 56 defines a plurality of key hole shaped openings 56*a* each of which openings is adapted to receive a cam roller 64 provided on a bellcrank 66 at one end of a rock shaft 68. Each rock shaft is rotatably supported in a finger holder or post 70. The post 70 is mounted in an opening 72*a* provided for this purpose in a fixed plate 74. The plate 74 is secured to the rotatable invert modular carrier 18. Two such plates are provided in the carrier and the carrier defines the ways 18*a* and 18*b* for slidably supporting the shifting cam plate as described above.

Each finger holder or post 70 supports up to four plastic fingers 50, 50 only one of which fingers is shown in FIG. 6. These fingers are resiliently formed or molded from a thermoplastic material so that when mounted on their associated holder each finger is normally biased toward a finger open position, that is the fingers normally assume positions for receiving articles dropped downwardly from the grid structure provided immediately above it, or for dropping an article downwardly from the pockets, the fingers help to define when the articles are dropped into the packing case in inverted relationship as suggested in FIGS. 2A–2D inclusively.

Each finger holder or post 70 has a tapered slot for receiving a correspondingly shaped projection adjacent the root end of each finger 50 as suggested in FIGS. 6 and 6A. As mentioned previously, each finger holder 70 also defines a bore for rotatably receiving a rock shaft 68. These rock shafts are adapted to be moved through approximately a 45 degree angle as suggested in FIG. 6 through one of the two shifting cam plate mechanism referred to previously. As shown in FIG. 6 the end of each rock shaft opposite the bell crank 66 includes a star shaped cam 76 having four lobes, each of which lobes is adapted to engage the back side of each of the four fingers 50, 50 to move these fingers collectively from their normal open positions to closed positions as referred to previously with reference to FIGS. 2A–2D inclusively.

As suggested in FIG. 1 and 2A–2D inclusively each case to be loaded is moved upwardly to mate with the downwardly facing closed fingers in the carrier or invert module. Once the case has been elevated, as suggested in FIG. 2A for example, the fingers move outwardly from their closed positions to open positions as suggested in FIG. 2B. This releases the articles for downward movement into the case.

As shown to best advantage in FIG. 2A, a very important feature of the present invention is that the fingers can be closed as the case moves up into position. This assures that the fingers are in position to guide the articles into the appropriate pocket or section of the packing case when the fingers reopen. The significant overlap between the upper edges of the case and the lower ends of the open fingers as shown in FIG. 2B and FIG. 5 is made possible as a result of the fingers being closed as the case mates with them, and only opened after the case has been lifted into position.

FIG. 7 shows a typical control system for operation of the various components of a packer according to the present invention. Lane detector switches LS1, LS2 and LS3 are provided in series so that one of the two invert module position indicator switches LS6 or LS7 will energize one of two control relays depending on which side of the carrier mechanism is in the up position for receiving an array or slug of articles from the shifting grid. As suggested in the last line of the FIG. 7 schematic a limit switch LS4 is provided adjacent to the path of movement of the case entering the lift table, as suggested in FIG. 2D, which limit switch LS4 closes so that the lift table can move up, provided that one of the two relays CR1 or CR2 has been energized.

Once the table reaches its up position another limit switch, LS5 best shown in FIG. 2A, closes causing the fingers of both sides of the carriage to open, and also opening the shifting grid from the position shown in FIG. 2A to that illustrated in FIG. 2B. A time delay relay TDR1 is also energized at the same time. Only after the contacts of this time delay relay have been closed will the fingers open and the downwardly facing charge of articles be dropped into the case as suggested in FIG. 2*b*. It should be noted that when the contacts TDR1 reopen, the fingers on both sides of the carrier so that the articles dropped into the carrier are captured or retained in place for the invert motion. Relay CR3 controls the invert and the revert movement of the grid as well as achieving return movement of the shifting grid apparatus as suggested in FIG. 7. While other control systems might be adapted for operation of the various components comprising an apparatus of the present invention the hard wired version shown in FIG. 7 is presented here for purposes of explaining the operation of the apparatus of the present invention.

I claim:

1. Apparatus for loading groups of articles into open packing cases and comprising:

article infeed conveyor means for moving articles in a plurality of side-by-side lanes in a downstream direction, lane defining grid means downstream of said article infeed conveyor means for successively receiving charges of articles, said grid means having movable article support elements for selectively releasing each charge of articles for downward movement out of said lane defining grid means, article carrier means below said grid means for receiving articles so released by said support elements, said carrier means including a first set of finger assemblies defining individual article receiving pockets, said finger assemblies having flexible fingers, said flexible fingers having free end portions normally in open positions forming said pockets for receiving articles, means for moving said finger free end portions from opened to closed positions, means for moving said carrier means while said fingers are closed to a load station where said first set of finger assemblies are inverted, said fingers being opened at said load station to drop the articles into an open packing case.

2. The combination according to claim 1 wherein said means for moving said carrier means comprises rotating said carrier means from an upright to an inverted position.

3. The combination according to claim 1 wherein each finger assembly includes a finger holder for the fingers of each finger assembly, a rock shaft provided in each holder, and a cam on said rock shaft for engaging said fingers of said finger assembly.

4. The combination according to claim 3 wherein said means for moving said rock shaft comprises a selectively movable cam plate provided in said carrier means, said rock shaft being rotated in response to cam plate shifting movement.

5. The combination according to claim 1 wherein said carrier means is movable between an article receiving station wherein said pocket defining fingers are open to receive articles released from said grid means and said load station wherein said pocket defining fingers are open to release the articles, said fingers being closed while said carrier means is so moved from said receiving station to said load station.

6. The combination according to claim 5 wherein said carrier means is supported for rotational movement between said stations on an axis oriented horizontally.

7. The combination according to claim 6 wherein said carrier means includes a second set of finger assemblies arranged diametrically opposite said first set of finger assemblies relative to said axis of carrier rotation.

8. The combination according to claim 6 wherein said second set of finger assemblies has flexible fingers defining a second set of pockets.

9. The combination according to claim 7 wherein said fingers of said second set in normal open positions receive articles into said second set of pockets.

10. The combination according to claim 8 wherein each of said finger assemblies of said second set also has a finger holder, a rock shaft provided in each holder, and a cam on said rock shaft for engaging said fingers of said second set of finger assemblies to selectively move said second fingers to closed positions.

11. The combination according to claim 10 wherein a second cam plate is provided for moving said second set of rock shafts, said carrier including a base defining ways for slidably supporting said second mentioned cam plate parallel said first cam plate, and means for moving said cam plates to open and closed positions corresponding to open and closed positions of said fingers of said sets of finger assemblies.

12. The combination according to claim 11 wherein cushioning means is provided in said carrier means for yieldably supporting the articles dropped into said first and second sets of pockets at said article receiving station.

* * * * *